United States Patent [19]

Clark et al.

[11] Patent Number: 4,819,870

[45] Date of Patent: Apr. 11, 1989

[54] RAIL FASTENING ASSEMBLY

[75] Inventors: Jack Clark; Norman R. Geedes, both of Lonsdale, Australia

[73] Assignee: Omark Industries, Inc., Portland, Oreg.

[21] Appl. No.: 703,696

[22] Filed: Feb. 21, 1985

[51] Int. Cl.[4] ..... E01B 9/48

[52] U.S. Cl. ..... 238/351; 238/349

[58] Field of Search ..... 238/310, 338, 331, 341, 238/347, 349, 351

[56] References Cited

U.S. PATENT DOCUMENTS

| | | | |
|---|---|---|---|
| 1,888,557 | 11/1932 | Kurkowski | 238/349 |
| 1,979,825 | 12/1932 | Dalton | 238/351 |
| 2,357,629 | 9/1944 | Cantrell et al. | 238/349 |
| 2,954,169 | 9/1960 | Rigby | 238/349 |

FOREIGN PATENT DOCUMENTS

| | | | |
|---|---|---|---|
| 2115464 | 9/1983 | United Kingdom | 238/351 |

*Primary Examiner*—Robert B. Reeves
*Assistant Examiner*—Gary C. Hoge
*Attorney, Agent, or Firm*—Charles F. Duffield

[57] ABSTRACT

An assembly is disclosed for securing a railroad rail to a base plate with a resilient fastener clip. The base plate is heated, punched and reforged to provide a clip locking shoulder which includes an aperture through the base plate and an undercut in the shoulder formed by first and second clip engaging surfaces forming a generally V-shaped clip interlock. The fastener clip is of generally U-shape configuration having an upper limb and lower limb interconnected by a heel portion. The lower limb terminates in a clip lock of generally V-shaped configuration complementary to the clip interlock of the clip shoulder and the clip interlock terminates in a clip lead-in formed at an angle complementary to the angulation of the first clip engaging surface.

6 Claims, 2 Drawing Sheets

RAIL FASTENING ASSEMBLY

BACKGROUND OF INVENTION

The present invention is concerned with means for securing railroad rails to metallic base plates or tie plates and, more specifically, to an assembly utilizing a resilient metallic fastener clip which interconnects in locking engagement with a clip locking shoulder formed in the base plate.

Metallic resilient clips for retaining the foot or base of railroad rails to a base plate have been known and in use for a number of years. The existing systems encounter several drawbacks.

One of the drawbacks is such systems do not provide a secure and positive interlock of the clip with the base plate but rely upon friction to maintain the clip in place.

Another drawback encountered in known rail retaining systems for securing railroad rails to base plates is that the fastening clips are of such a design as to require the utilization of special tools for insertion of the clip into engagement with the base plate.

One such system having the foregoing drawback is that disclosed in U.S. Pat. No. 2,312,026 issued to Cantrell, et al. In this patent there is disclosed the use of a U-shaped metallic fastening clip which cooperates with an aperture and shoulder to secure the clip to the base plate. However, in this system, the base plate and lower limb of the fastening clip are so formed that the fastening clip cannot be driven into interlocked engagement with the base plate. A special tool must be utilized to spread apart the upper and lower limbs prior to insertion of the clip into engagement with the rail base or foot and base plate and then released. In a like manner, removal of the fastening clip can only be achieved by the reverse procedure, i.e. utilization of the special tool to spread apart the upper and lower limbs.

What is needed in the industry is a resilient rail fastening clip and design of interlock on the base plate which will permit the clip to be driven into engagement with the base plate by ordinary devices such as a sledge hammer to thus avoid the necessity of special tools.

OBJECT AND SUMMARY OF INVENTION

It is the object of the present invention to provide a railroad rail fastening clip which operates in conjunction with a base plate of the type and nature that will provide for positive interlock of the fastening clip with the base plate while permitting installation of the fastening clip by means of ordinary tools.

The rail fastening assembly of the present invention utilizes a conventional rail base plate which has been reworked by punching and forging to provide a clip locking shoulder.

The clip locking shoulder has an undercut formed therein positioned above an aperture punched through the base plate. The undercut of the clip locking shoulder includes a first clip engaging surface which slopes downwardly and joins a second clip engaging surface which slopes upwardly in a transverse direction towards the rail seat to form a V-shaped clip interlock.

The fastening clip utilized with the assembly is of a general U-shaped configuration having an upper and lower limb interconnected through a heel. The lower limb of the fastening clip terminates in a clip lock of a generally V-shaped configuration complementary to the clip interlock of the clip locking shoulder of the base plate.

The clip interlock of the lower limb of the fastening clip terminates in a clip lead-in. The clip lead-in is sloped at an angle complementary to the first clip engaging surface.

The undercut portion of the clip locking shoulder further includes a downwardly sloping abutment at the end of the second clip engaging surface of the V-shaped clip interlock. The angulation of the abutment matches the angle of the clip lead-in.

During installation of the clip, the clip lead-in will engage the first clip engaging surface and provide a camming action to permit the clip upper and lower limbs to spread as the clip is driven further into engagement with the base plate. Once the clip has been driven to the point where the clip interlock of the fastening clip is in mating engagement with the V-shaped clip interlock of the base plate, the clip lead-in will engage the abutment of the clip locking shoulder to prevent overdriving of the clip.

Other objects and advantages of the rail fastening system of the present invention will be apparent from the detailed description thereof which follows.

DETAILED DESCRIPTION OF INVENTION

Figure 1:
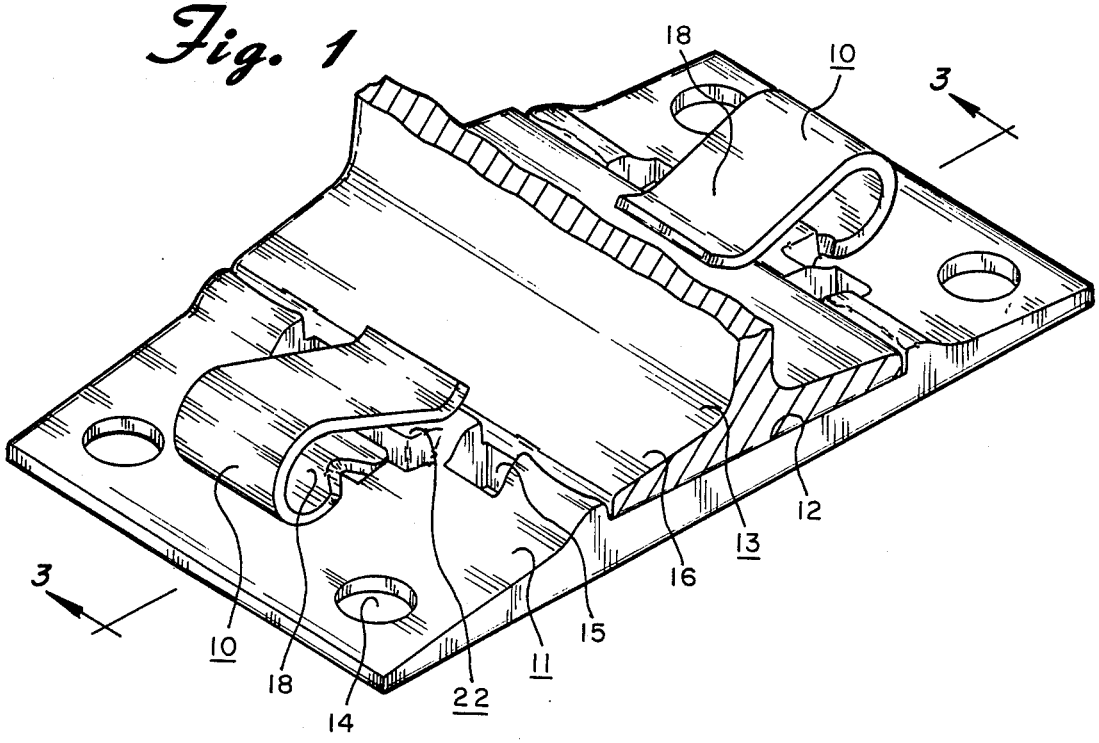
FIG. 1 is a perspective view of the clip fastening system of the present invention showing one clip fully installed and the other prior to installation.
Figure 2:
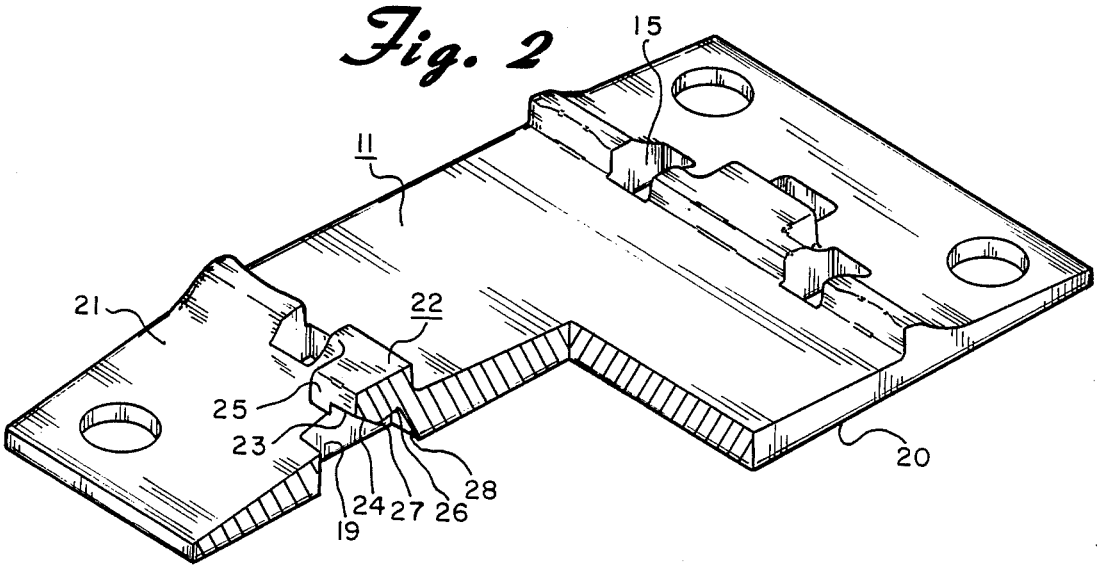
FIG. 2 is a perspective view partially in section of a base plate showing the clip locking shoulder of the present invention.
Figure 3:
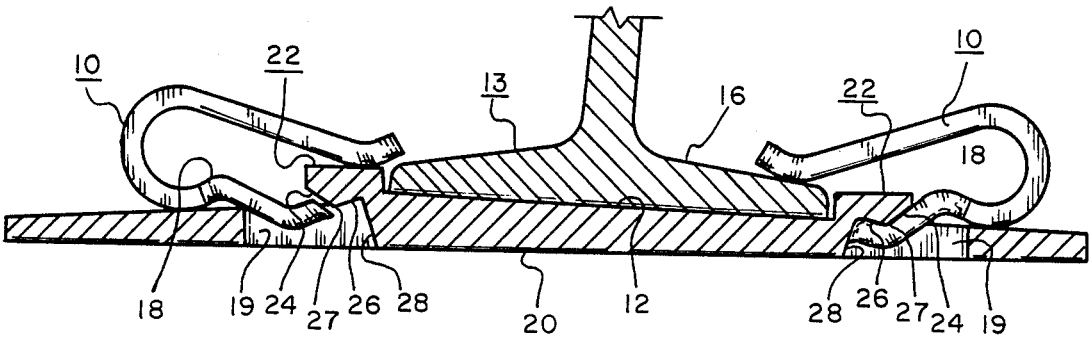
FIG. 3 is a cross-sectional view along the line 3—3 of FIG. 1 showing one clip in installed position and the other prior to installation.
Figure 4:
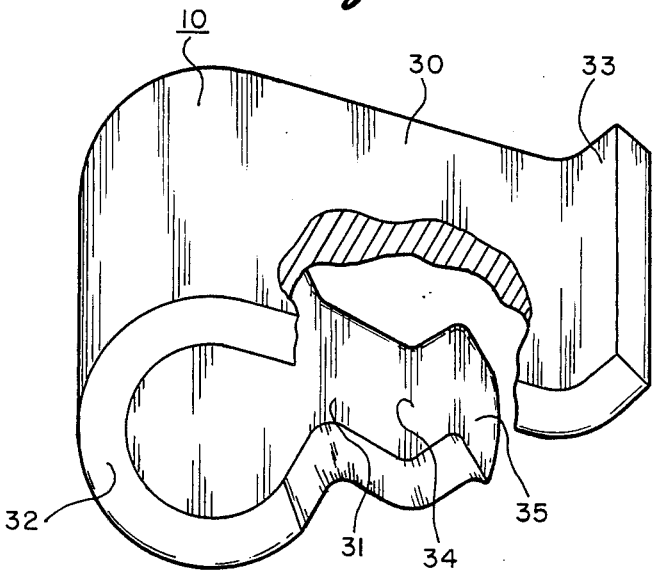
FIG. 4 is a perspective view partially in section of the fastening clip of the present invention.

The rail fastening system of the present invention may be seen from FIGS. 1–4 of the drawings. The system includes a fastening clip 10 and a reworked base plate 11. The details of the base plate 11 are shown in FIGS. 2 and 3 of the drawings and the details of the fastening clip 10 are shown in FIG. 4 of the drawings.

In general and as may best be seen in FIG. 1, the base plate 11 has formed therein a rail seat 12 for receiving a railroad rail 13.

The base plate, prior to being reworked, is a conventional base plate. The base plate includes the commonly known hold-down spike holes 14 for securing the base plate to a railroad tie. Gauge spikes normally positioned within the conventional gauge spike holes 15 are not used and are replaced by the fastening assembly of the present invention.

As may be seen in FIG. 1, the base plate 11 includes a reworked clip locking shoulder 22 as will be described in more detail hereinafter. The lower limb 18 of the fastening clip 10 is designed to engage the clip locking shoulder 22 whereupon the fastening clip 10 can be driven into locking engagement, with the upper limb 30 of the fastening clip 10 in engagement with the rail foot or base 16. FIG. 1 illustrates the rail clip 10 on the left hand side prior to its being driven into locking engagement with the base plate 11 while the right hand side of FIG. 1 illustrates the fastening clip 10 in locked position.

The details of the base plate 11 are shown in FIGS. 2 and 3 of the drawings. The base plate is a reworked conventional base plate. The base plate 11 is placed in an apparatus which includes a combined punch and forging die. The base plate is heated by means such as propane torches to a temperature of approximately 1550° F.

Following heating, the process continues in a fashion such that the punch and forging die moves from the lower surface 20 toward the upper surface 21 of the base plate to punch an aperture 19 in the base plate while the forging die forges a clip locking shoulder 22 above the upper surface 21 of the base plate.

The clip locking shoulder 22, during the forging operation, has formed therein an undercut 23. The undercut 23 has formed therein a first clip engaging surface 24 which slopes downwardly from the face 25 of the clip locking shoulder 22 to a terminal point wherein it intersects a second clip engaging surface 26.

The second clip engaging surface 26 slopes upwardly in a direction transverse to and toward the rail seat 12. In this manner, the first and second clip engaging surfaces 24 and 26 respectively form a V-shaped clip interlock 27.

The second clip engaging surface 26 terminates at an abutment 28. The abutment 28 extends downwardly from the second clip engaging surface at an angle complementary to the angle of a clip lead-in on the fastening clip to be described hereinafter.

The clip locking shoulder 22 and its associated V-shaped clip interlock 27 are at a height above the lower surface 20 of the base plate a height in excess of the thickness of the lower limb of the fastening clip. As will be described in more detail hereinafter, this height is positioned such that the lower limb of the clip can move into locking engagement with the clip locking shoulder without extending below the lower surface 20 of the base plate 11 thus avoiding interference with the surface upon which the base plate is positioned. Additionally, by varying the height of the V-shaped interlock 27 above the lower surface 20 of the base plate, variations in the spring pressure exerted by the fastening clip 10 upon the rail foot 16 may be achieved.

The details of the fastening clip 10 of the present invention are shown in FIG. 4 of the drawings. The fastening clip 10 is of a generally U-shaped configuration and includes an upper limb 30 and a lower limb 18 interconnected through a heel 32. The clip is formed of a resilient spring steel.

The upper limb 30 includes at its terminus an upturned cam 33. This cam 33 facilitates the upper limb in camming upon the rail foot 16 during installation of the fastening clip.

The lower limb 18 of the fastening clip 10 includes a clip lock 34. The clip lock 34 is of a V-shape configuration generally complementary with the V-shaped clip interlock 27 of the clip locking shoulder 22.

The clip lock 34 terminates in a clip lead-in 35. The angulation of the clip lead-in 35 is substantially complementary to the angulation of the first clip engaging surface 24.

The lower limb 18 of the fastening clip 10, in the vicinity of the clip lock 34, is of a reduced width. The reduced width of the lower limb 18 of the fastening clip permits the utilization of smaller clip locking shoulders in base plates wherein the spacing between the gauge spike holes 15 adjacent the rail seat 12 is of a limited nature. However, as will be discussed hereinafter, inasmuch as the heel 32 of the fastening clip 10 rests upon the upper surface 21 of the base plate 11 when in place, there is little or substantially no loss of spring tension when the clip is installed.

The installation of the fastening clip 10 to the base plate 11 may best be seen in FIG. 3 of the drawings. As the fastening clip 10 is moved into position as shown in the left hand side of FIG. 3, the clip lead-in 35 will match the angulation of the first clip engaging surface 24. As the clip is driven further into its locked position, the clip lead-in will provide a camming action sliding downwardly over the first clip engaging surface 24. As the clip is further driven inwardly toward the rail seat 12, the upper and lower limbs will be spread apart until finally the clip lock 34 comes into mating engagement with the V-shaped clip interlock 27.

As may best be seen in FIG. 3, once the clip has reached its mating engagement between the clip lock 34 and the V-shaped clip interlock 27, the clip lead-in 35 will be in mating engagement with the abutment 28 to prevent any further movement of the clip past its locked position.

The fastening clip 10 of the rail fastening system of the present invention may be installed by the use of a conventional sledge hammer or other objects to merely drive the clips in place. However, once the fastening clip 10 is in place, it resists removal without a removal tool. This is a safety feature to prevent the intervention of vandals or unauthorized removal.

By way of example but not limitation, a fastening clip according to the present invention is approximately $1\frac{7}{8}$ inches wide in the upper limb and 1 inch wide in the area of reduced width at the clip lock. The radius of the heel is approximately $\frac{1}{2}$ inch. The thickness of the spring steel utilized in the fastening clip is approximately $\frac{1}{4}$ inch although the thickness may be varied to change the spring pressure. When in place, the upper limb of the clip will exert 2250 lbs of force upon the rail foot.

The present invention has been described in respect to a preferred embodiment thereof shown in the drawings. Other variations and modifications will now become apparent to those skilled in the art by reason of the foregoing description of a preferred embodiment. Accordingly, no limitation as to the scope of the invention is to be taken from the preferred embodiment shown in the drawings but the scope of the invention is to be determined in accordance with the appended claims.

What is claimed is:

1. An assembly for securing a railroad rail comprising:

a rail base plate having an upper surface and a lower surface;

a rail seat formed in the upper surface of the base plate adapted to receive a rail foot of a railroad rail;

at least one clip locking shoulder formed in the upper surface of the rail plate adjacent the rail seat;

the clip locking shoulder including an undercut therein having a first clip engaging surface sloping downwardly and joining a second clip engaging surface sloping upwardly in a direction transverse to and toward the rail seat to form a generally V-shaped clip interlock;

at least one resilient fastener clip of a generally U-shaped configuration having an upper limb, a lower limb and a heel interconnecting the upper and lower limbs; and the lower limb of the fastener clip terminating in a clip lock of configuration generally complementary to the configuration of the clip interlock of the clip locking shoulder whereby the fastener clip may be driven into locking engagement with the base plate to secure a rail in place with the upper limb of the fastener clip in engagement with the rail foot, the heel of the fastener clip in engagement with the upper surface of the base plate and the clip lock of the lower limb of the fastener clip in locked engagement with the first and second clip engaging surfaces that form the clip interlock of the clip locking shoulder.

2. The assembly of claim 1 wherein the clip lock on the lower limb of the fastener clip terminates in a clip lead-in formed at an angle generally complementary to the angulation of the first clip engaging surface to permit the fastener clip to be driven into locked position with the base plate without the use of special tools.

3. The assembly of claim 2 wherein the clip interlock of the clip locking shoulder terminates in a downwardly projecting abutment which the clip lead-in engages to prevent overdriving of the fastener clip during installation of the clip.

4. The assembly of claim 3 wherein the abutment is formed at an angle generally complementary to the angulation of the clip lead-in to provide firm engagement of the clip lead-in with the abutment.

5. The assembly of claim 1 wherein the clip locking shoulder includes an aperture through the base plate and wherein the clip interlock is positioned within the aperture and above the lower surface of the base plate a distance which exceeds the thickness of the fastener clip lower limb.

6. The assembly of claim 1 wherein the clip locking shoulder is formed by heating the base plate, punching an aperture in the base plate and forging the clip locking shoulder upwardly from the upper surface of the base plate.

* * * * *